US005924600A

United States Patent [19]

Keller

[11] Patent Number: 5,924,600

[45] Date of Patent: Jul. 20, 1999

[54] MEANS FOR THE CORRECT ATTACHMENT OF A MULTIPLE COMPONENT CARTRIDGE TO A DISPENSING APPLIANCE

[76] Inventor: Wilhelm A. Keller, Obstgartenweg 9, Merlischachen, Switzerland, CH-6402

[21] Appl. No.: 08/799,186

[22] Filed: Feb. 12, 1997

[30] Foreign Application Priority Data

Feb. 21, 1996 [EP] European Pat. Off. ..... 96810102

[51] Int. Cl.[6] ..... B67D 5/52

[52] U.S. Cl. ..... 222/137; 222/325; 222/326; 222/327

[58] Field of Search ..... 222/137, 145.5, 222/145.6, 325, 326, 327, 181.2, 181.3; 141/383, 384, 375, 378, 367, 369

[56] References Cited

U.S. PATENT DOCUMENTS

| | | | |
|---|---|---|---|
| 1,136,502 | 4/1915 | Babos . | |
| 2,816,518 | 12/1957 | Daggett . | |
| 3,143,255 | 8/1964 | Leeds . | |
| 3,323,682 | 6/1967 | Creighton et al. . | |
| 3,498,642 | 3/1970 | Berger . | |
| 3,884,388 | 5/1975 | Holcomb . | |
| 4,014,463 | 3/1977 | Hermann . | |
| 4,117,551 | 9/1978 | Books et al. . | |
| 4,150,673 | 4/1979 | Watt | 141/367 |
| 4,211,439 | 7/1980 | Moldestad . | |
| 4,240,566 | 12/1980 | Bergman . | |
| 4,432,469 | 2/1984 | Eble et al. . | |
| 4,449,737 | 5/1984 | Specht . | |
| 4,471,888 | 9/1984 | Herb et al. . | |
| 4,538,920 | 9/1985 | Drake . | |
| 4,566,610 | 1/1986 | Herb . | |
| 4,687,663 | 8/1987 | Schaeffer . | |
| 4,690,306 | 9/1987 | Staheli . | |
| 4,747,517 | 5/1988 | Hart . | |
| 4,753,536 | 6/1988 | Spehar et al. . | |
| 4,767,026 | 8/1988 | Keller et al. . | |
| 4,771,919 | 9/1988 | Ernst . | |
| 4,846,373 | 7/1989 | Penn et al. . | |
| 4,869,400 | 9/1989 | Jacobs . | |
| 4,871,090 | 10/1989 | Hoffman . | |
| 4,913,553 | 4/1990 | Falco . | |
| 4,946,079 | 8/1990 | Campbell . | |
| 4,974,756 | 12/1990 | Pearson et al. . | |
| 4,978,336 | 12/1990 | Capozzi et al. . | |
| 4,981,241 | 1/1991 | Keller . | |
| 4,989,758 | 2/1991 | Keller . | |
| 4,995,540 | 2/1991 | Colin et al. . | |
| 5,005,735 | 4/1991 | Keller | 222/137 |
| 5,020,694 | 6/1991 | Pettengill . | |
| 5,022,563 | 6/1991 | Marchitto et al. . | |
| 5,033,650 | 7/1991 | Colin et al. . | |
| 5,038,963 | 8/1991 | Pettengill et al. . | |
| 5,065,906 | 11/1991 | Meader . | |
| 5,080,262 | 1/1992 | Herold et al. . | |
| 5,100,030 | 3/1992 | Roggenburg, Jr. et al. | 222/181.2 |
| 5,137,182 | 8/1992 | Keller . | |
| 5,228,599 | 7/1993 | Keller . | |
| 5,249,709 | 10/1993 | Duckworth et al. . | |
| 5,249,862 | 10/1993 | Herold et al. | 222/137 |
| 5,289,949 | 3/1994 | Gentile . | |
| 5,333,760 | 8/1994 | Simmen . | |
| 5,413,253 | 5/1995 | Simmen . | |
| 5,609,271 | 3/1997 | Keller et al. . | |

FOREIGN PATENT DOCUMENTS

| | | |
|---|---|---|
| 2232910 | 1/1991 | United Kingdom . |

*Primary Examiner*—David J. Walczak
*Assistant Examiner*—Timothy L. Maust
*Attorney, Agent, or Firm*—Foley & Lardner

[57] ABSTRACT

A two component cartridge is attached to a dispensing appliance with a coding to enable proper attachment. The cartridge has a flange with a coding cutout. The dispensing appliance has a holder for receiving the flange. The holder has a coding protrusion that is complementary with the coding cutout. This cartridge has outlets with a coded attachment for attaching accessories. The coding feature facilitates quick and easy attachment of accessories, such as a mixer or cap to the cartridge outlets.

9 Claims, 3 Drawing Sheets

MEANS FOR THE CORRECT ATTACHMENT OF A MULTIPLE COMPONENT CARTRIDGE TO A DISPENSING APPLIANCE

BACKGROUND OF THE INVENTION

The present invention relates to a device for correctly attaching of a multiple component cartridge to a dispensing appliance or filling device having a holder for receiving a flange of the cartridge.

The use of two or more component cartridges with manually and pneumatically driven dispensing appliances is well known. The cartridges are held within a framework at the front of the dispenser, with the front face of the cartridge supported structurally against the inside front of the frame when under a dispensing load. In the case of smaller cartridges, prior art U.S. Pat. No. 5,005,735 shows the use of a single holding flange at the rear of the two cartridge cylinders, which flange fits into grooves at the front of a dispenser. Prior art U.S. Pat. No. 5,330,079 shows an integral double holding flange with strengthening webs in between.

Whereas these types of rear flanges allow cartridges to be attached to a dispenser in two orientations, there now comes a new requirement for attaching a cartridge to a dispenser in a single orientation only in a fixed relative orientation, both to facilitate the ongoing coded alignment and coded attachment of accessories in a fixed orientation to the cartridge front outlets, such as a mixer and closure cap, and to align and to display a message, such as a warning or instruction on the cartridge, in a fixed orientation relative to an operator for viewing purposes. Furthermore, the same need arises for a cartridge within a holding device of filling equipment so as to ensure a specific orientation and connection of filling device outlets to cartridge inlets or outlets during filling or refilling.

SUMMARY OF THE INVENTION

On the basis of this prior art, it is an object of the present invention to provide for an attachment of a multiple component cartridge to a dispensing appliance in a single orientation only and a further object to ensure a fixed relationship between this orientation, and a coding means of the cartridge front outlets.

These objects can be attained with a cartridge dispenser that has a cartridge and a dispensing appliance or a filling device. The cartridge has a coding, an elongated flange, and two or more containers extending from one side of the flange and positioned along a longitudinal axis of the flange. The dispensing appliance and the filling device each has a holder for receiving the flange. The holder also has a coding that is complementary with the cartridge coding to allow connection in a single orientation only. The holder is configured to receive the dispensing appliance or the filling device with both codings aligned in a direction perpendicular to a longitudinal axis of the containers so that the cartridge is introduced into the holder perpendicular to the container longitudinal axis and perpendicular to the flange longitudinal axis.

In another aspect of the invention, the cartridge has first and second codings, two or more containers each with an outlet. The flange is formed opposite the outlets and the second coding is formed adjacent to the outlets. The second coding comprises a visual indication and a separate single orientation connector for an accessory attachable to the outlets.

In other aspects, one of the codings of the cartridge and the holder is a cutout, and the other of the coding of the cartridge and the coding of the holder is a protrusion that is complementary with the cutout. The cartridge coding can comprise a cutout formed on one edge of the flange and the holder coding can comprise a protrusion that is complementary with the cutout. The cartridge containers can have unequal diameters, the flange differently sized portions, and the holder can have cutouts that are complementary with the unequal diameter containers and a pocket that is complementary with the flange. The cartridge coding can comprise the unequal diameter containers and the flange, and the flange coding can comprise the cutouts and the pocket.

The cartridge containers can each include an outlet and the cartridge can further include another coding adjacent to the outlets of the containers. The additional coding can comprise a visual indication for proper orientation of an accessory attachable to the outlets. The additional coding can include a single orientation connector for the accessory attachable to the outlets.

According to another aspect of the invention includes a method of attaching a cartridge having two or more containers to a dispensing appliance and a filling device having a holder for receiving the cartridge. The method comprises providing the cartridge with a coding and an elongated flange, and with the containers extending from one side of the flange and positioned along a longitudinal axis of the flange; providing the holder with a coding that is complementary with the cartridge coding; aligning the flange coding with the holder coding; and moving the flange or the holder or both relatively toward each other in a direction perpendicular to a longitudinal axis of the containers, while the longitudinal axis of the flange is oriented perpendicular to the moving direction.

BRIEF DESCRIPTION OF THE DRAWINGS

The invention will be explained in more detail hereinafter with reference to drawings.

DETAILED DESCRIPTION OF THE INVENTION

Figure 1:
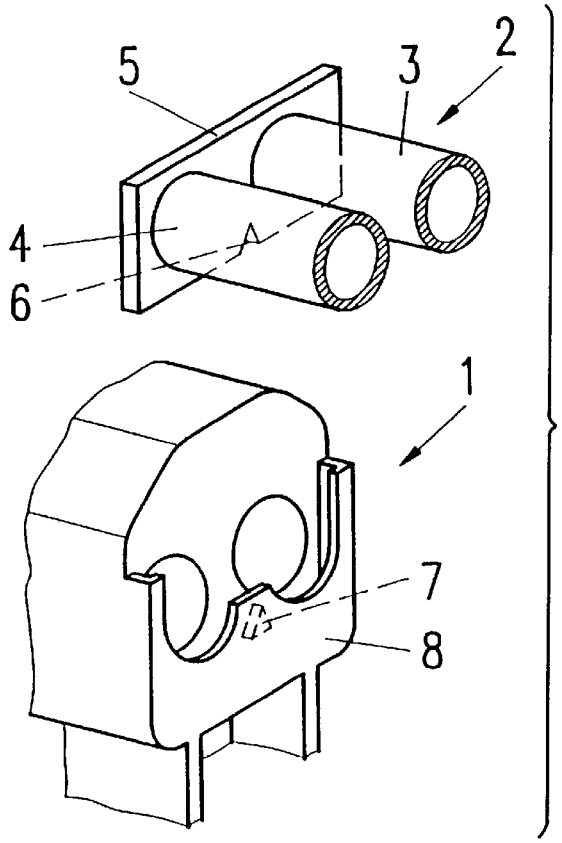
FIG. 1 shows in an exploded view the rear part of a two component cartridge and the front part of an appliance with a coded attachment according to the invention.

FIG. 1 illustrates an exploded view of a rear part of a two component cartridge 2 comprising two containers 3, 4. These containers may be cylinders of equal cross sectional area such as for a 1:1 volumetric ratio, integral with a single plate flange 5 at the rear. The flange 5 rectangular in shape and incorporates a V-shape cut out 6 at the lower edge as a wax of coding for proper mating with a complementary V-shape protrusion 7 on a holder 8 of a dispenser 1 for aligned attachment in one orientation only. Instead of a dispenser, it could also be a holding device on a filling apparatus (not shown).

Figure 2:
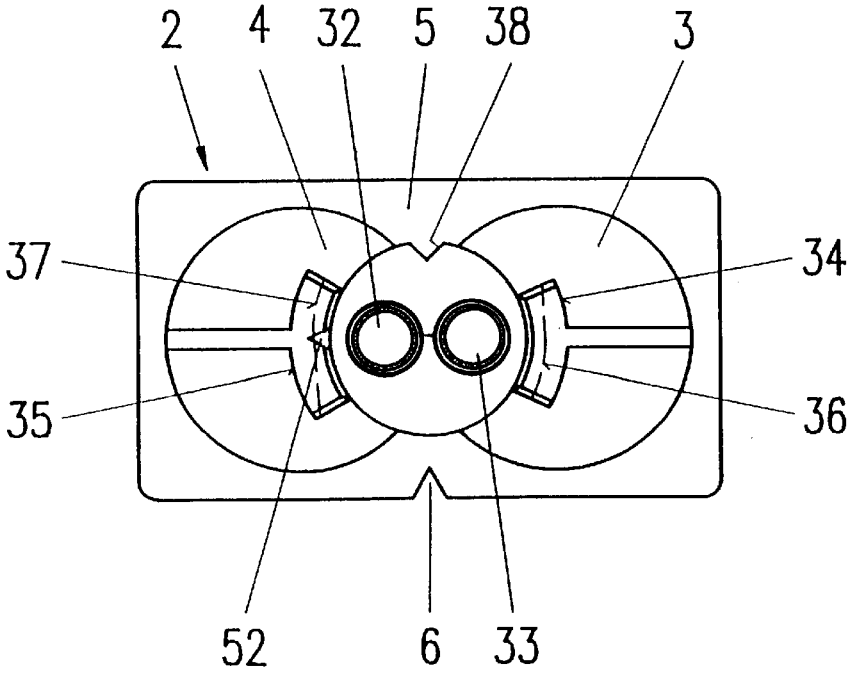
FIG. 2 shows a front view of the cartridge of FIG. 1.

FIG. 2 shows a front view of the same cartridge 2 as in FIG. 1 with the flange 5 and the cylinders 3, 4 leading to outlets 32 and 33 at the cartridge front. The flange 5 with the V-shape cutout 6, fitted to a dispenser, ensures that a V-shape notch 38 formed at the cartridge front is automatically positioned upright (as viewed from FIG. 2) so that it may be used to visually align and match a V-shape notch of an accessory, such as a mixer (not shown), before mechanically attaching that mixer in a coded orientation.

The mechanical coded attachment of a mixer or accessory can comprise, for example different width mixer/accessory cutout between bayonet attachment lugs (not shown) aligning with different width cartridge sector shaped bayonet sockets 34 and 35 before the mixer/accessory lugs engage within the internal recesses 36 and 37. One of the bayonet sockets, here 35, may be provided further with a V-shape cutout 52 for allowing the introduction of a complementary protrusion at the accessory or mixer (not shown) or preventing a attachment of the mixer or accessory when presented in the wrong orientation.

The coded attachment orientation of the cartridge relative to the dispenser provides allows a predetermined orientation of the cartridge prior to the coded attachment of a mixer or accessory to the cartridge front, and will assist an operator to routinely and quickly connect an accessory, such as a mixer or closure cap, to the cartridge front outlets. The same situation would apply when attaching a cartridge to a holding device of a filling apparatus.

Figure 3:
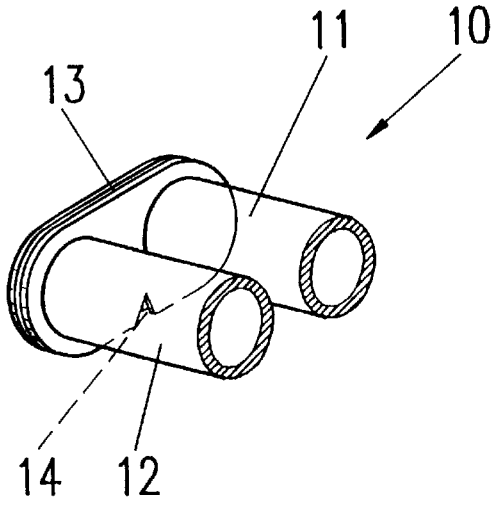
FIG. 3 shows a perspective view of the rear part of a variant of the cartridge of FIG. 1.

FIG. 3 illustrates as a variant to the cartridge 2 of FIG. 1 a perspective view of a cartridge 10 comprising two containers 11, 12 of equal cross sectional area integral with a double flange 13 at the rear. The flange 13 is rounded at the sides and incorporates a V-shape cutout 14 at the lower edge as a way of coding for proper attachment to a dispenser or holding device of filling equipment. It is evident that the holding device at the dispenser is matched to the rounded flange of the cartridge. The coded front part of the cartridge can remain as same as in FIG. 2.

Figure 4:
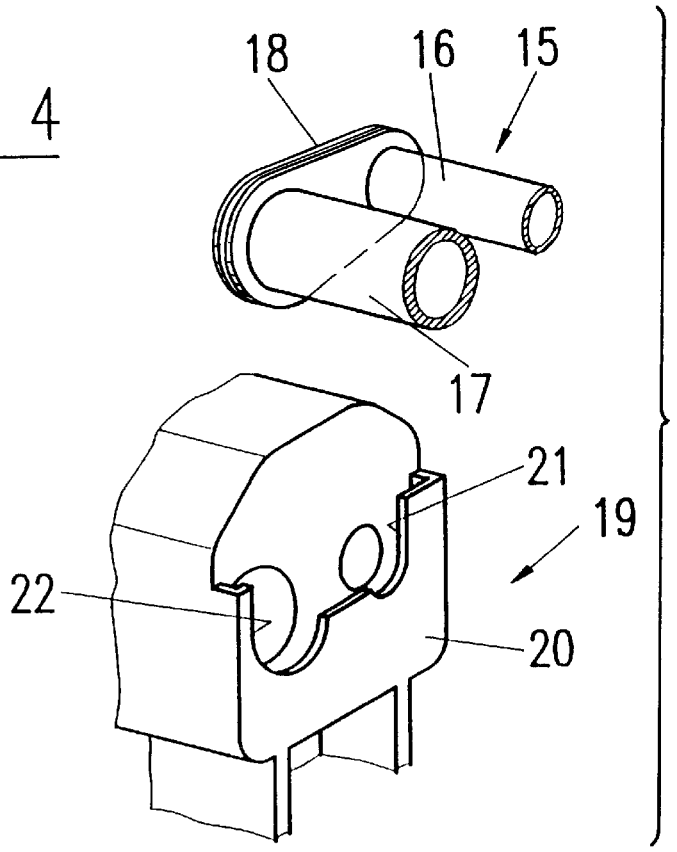
FIG. 4 shows in an exploded view a second embodiment of the rear part of a two component cartridge and the front part of an appliance with a coded attachment according to the invention.

FIG. 4 illustrates an exploded view of another embodiment of a cartridge 15 comprising two containers 16 and 17, of unequal cross sectional area, such as for a 10:1 volumetric ratio, integral with a double flange 18 at the rear. The flange 18 is rounded and follows the unequal contours of the containers 16 and 17. This unsymmetrically rounded shape, in itself, acts as a way of coding for proper attachment to a dispenser or holding device of a filling apparatus. The dispenser or filling apparatus 19 comprises at its front part a holder 20 with two unequally shaped cutouts 21, 22 for receiving the two unequal containers 16, 17 and retaining means, such as grooves, or a pocket of unequal inside contours for receiving the flange.

Figure 5:
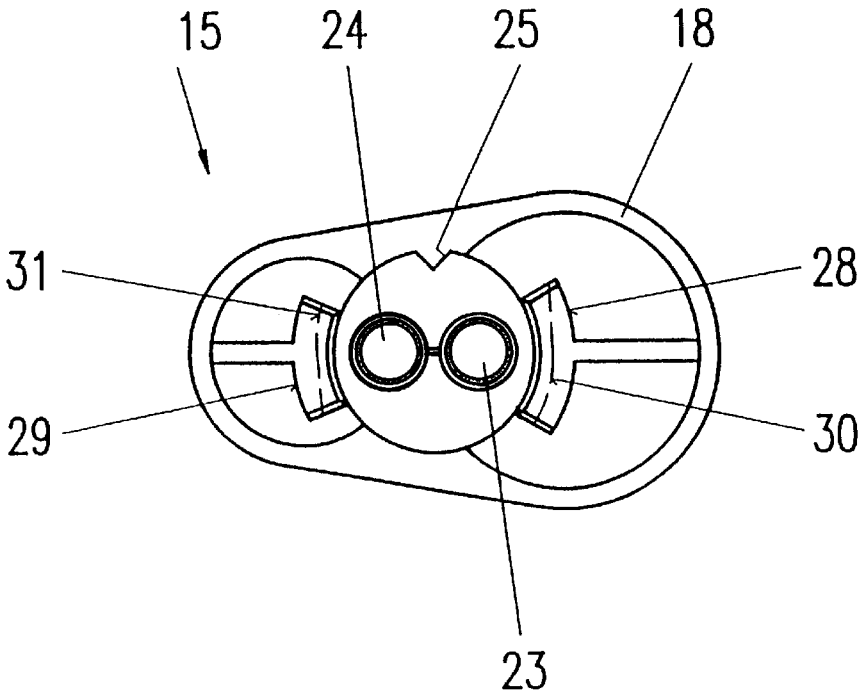
FIG. 5 shows a front view of the cartridge of FIG. 4.

FIG. 5 shows another example of a relationship between the orientation of a coded cartridge flange relative to the coded front outlets specifically in regard to FIG. 4 cartridge 15. The the orientation and attachment of the flange 18 in one position only relative to a dispenser, continues as a method of ensuring correctly orientating the front of the cartridge 15 for the coded visual and mechanical attachment of a mixer or accessory to the outlets 23 and 24 while the cartridge 15 remains attached to the dispenser. Again, a V-shape notch 25 at the front of the cartridge 15 will follow as automatically positioned upright (as view 1 from FIG. 5) so that it may be used to visually align and match a complementary V-shape notch at a mixer (not shown) before mechanically attaching that mixer in a proper orientation.

The mechanical coded attachment may comprise different width cutouts between the mixer bayonet attachment lugs (not shown) aligning with different width cartridge sector shaped bayonet sockets 28 and 29 before the mixer lugs engage within the internal recesses 30 and 31. This cartridge may also be provided with a V-shape cutout at one bayonet socket to match a protrusion on a mixer or accessory.

Figure 6:
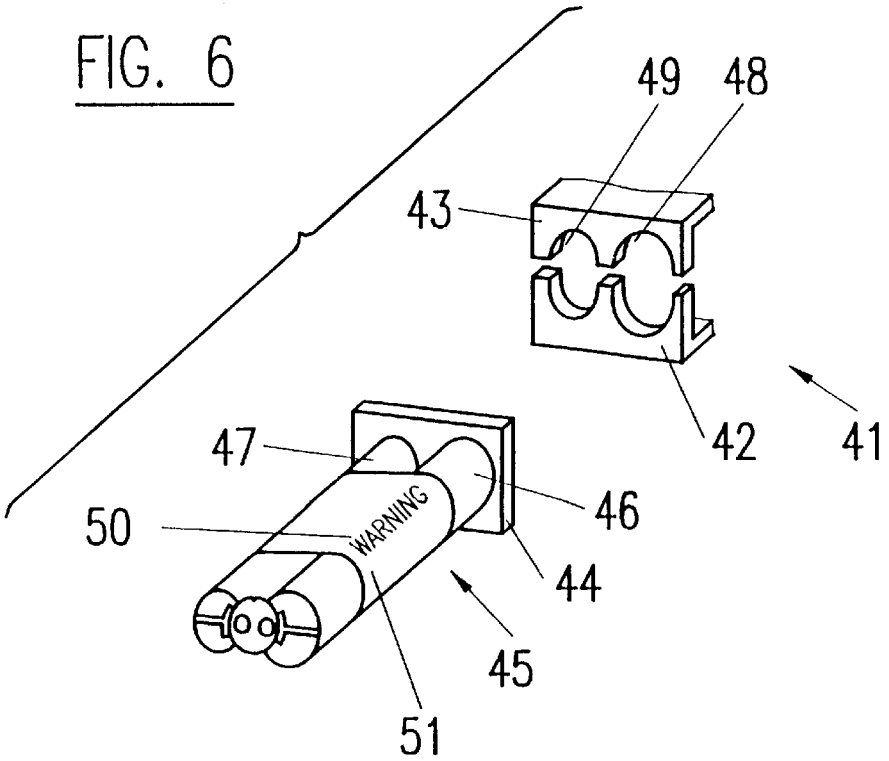
FIG. 6 shows in an exploded view a further cartridge and a holding device with a coded attachment according to the invention.

FIG. 6 shows an exploded view of a holding device front 41 with front attachment lower fixed jaws 42 and pivoting jaws 43. The flange 44 is part of a cartridge 45 which has unequal containers 46 and 47. The unequal diameters form a mechanical coding, respectively in relation to the retention diameters 48 and 49 of the jaws 42 and 43. The resulting cartridge orientation in one position only allows the attached label 50 to be upright for correct viewing presentation of the message 51 to an operator.

It follows from the foregoing that the coded attachment of a cartridge to a dispenser or filling apparatus can also be used to align the cartridge outlets for the coded attachment of a mixer, accessory or filling nozzles. It is also understood that the coding notches, cutouts and protrusions are not necessarily V-shape and can have any other shape.

All disclosed examples show that the cartridge is introduced into the holder of the dispensing apparatus or filling device perpendicular to the axis connecting the two centers of the containers.

I claim:

1. A dispensing assembly comprising:

a cartridge having first and second codings, two or more containers each with an outlet, and a flange opposite the outlets, said second coding being formed adjacent to said outlets;

a dispensing appliance or a filling device having a holder for receiving said flange, said holder having a coding that is complementary with the cartridge coding to allow said cartridge to be connected to said holder in a single orientation only, wherein said second coding comprises a visual indication and a separate connector for an accessory attachable to said outlets in a single orientation.

2. A dispensing assembly comprising:

a cartridge having a coding, an elongated flange, and two or more containers extending from one side of said flange and positioned along a longitudinal axis of said flange;

a dispensing appliance or a filling device having a holder for receiving said flange, said holder having a coding that is complementary with the cartridge coding to allow connection in a single orientation only, wherein said holder is configured to receive said dispensing appliance or said filling device with both said codings aligned in a direction perpendicular to a longitudinal axis of said containers so that said cartridge is introduced into said holder perpendicular to the container longitudinal axis and perpendicular to the flange longitudinal axis.

3. A dispensing assembly according to claim 2, wherein one of said codings of said cartridge and said holder is a cutout, and the other of said codings of said cartridge and said holder is a protrusion that is complementary with said cutout.

4. A dispensing assembly according to claim 2, wherein said cartridge coding comprises a cutout formed on one edge of said flange and the holder coding comprises a protrusion that is complementary with said cutout.

5. A dispensing assembly according to claim 2, wherein the cartridge containers have unequal diameters, said flange has differently sized portions, and said holder has cutouts that are complementary with the unequal diameter containers and a pocket that is complementary with said flange, said cartridge coding comprising said unequal diameter containers and said flange, and said flange coding comprising said cutouts and said pocket.

6. A dispensing assembly according to claim 2, wherein the cartridge containers each include an outlet, said cartridge further includes another coding adjacent to the outlets of said containers.

7. A dispensing assembly according to claim 6, wherein said another coding comprises a visual indication for proper orientation of an accessory attachable to said outlets.

8. A dispensing assembly according to claim 7, wherein said another coding further includes a single orientation connector for the accessory attachable to said outlets.

9. A method of attaching a cartridge having two or more containers to a dispensing appliance and a filling device having a holder for receiving the cartridge, comprising:

providing the cartridge with a coding and an elongated flange, and with the containers extending from one side of said flange and positioned along a longitudinal axis of the flange;

providing the holder with a coding that is complementary with the cartridge coding;

aligning the flange coding with the holder coding; and moving the flange or the holder, or both relatively toward each other in a direction perpendicular to a longitudinal axis of the containers, while the longitudinal axis of the flange is oriented perpendicular to the moving direction.

* * * * *